US007950383B2

(12) United States Patent
Brant et al.

(10) Patent No.: US 7,950,383 B2
(45) Date of Patent: May 31, 2011

(54) VENTILATING KITCHEN RANGE SUBFRAME

(75) Inventors: Ronald G. Brant, Greenbrier, TN (US); Adam Clark, Erin, TN (US); James Marler, Greenbrier, TN (US)

(73) Assignee: Electrolux Home Products, Inc., Cleveland, OH (US)

( * ) Notice: Subject to any disclaimer, the term of this patent is extended or adjusted under 35 U.S.C. 154(b) by 369 days.

(21) Appl. No.: 12/103,984

(22) Filed: Apr. 16, 2008

(65) Prior Publication Data

US 2009/0260616 A1 Oct. 22, 2009

(51) Int. Cl.
*F24B 5/02* (2006.01)
*F24B 5/06* (2006.01)

(52) U.S. Cl. ..... 126/1 R; 126/193; 126/220; 126/300; 312/236; 454/184; 454/193

(58) Field of Classification Search ..... 126/193, 126/220, 300, 302, 303, 1 R; 312/236; 454/184, 454/193
See application file for complete search history.

(56) References Cited

U.S. PATENT DOCUMENTS 2,525,614 A * 10/1950 Nelson et al. ..... 126/299 R
2,715,173 A * 8/1955 Farquharson ..... 219/450.1
2,811,913 A * 11/1957 Anderson ..... 454/157
3,081,763 A * 3/1963 Newell, Jr. etal. ..... 126/21 R
3,364,912 A * 1/1968 Dills et al. ..... 126/21 A
3,384,067 A * 5/1968 Rawald et al. ..... 126/21 A
3,512,514 A * 5/1970 Vonasch ..... 126/21 A
3,646,927 A 3/1972 Perl
3,756,217 A 9/1973 Field
3,838,505 A * 10/1974 Doner ..... 29/611
3,870,862 A * 3/1975 Doner ..... 219/452.12
3,877,457 A * 4/1975 Doner ..... 126/39 R
3,882,843 A * 5/1975 Barnett ..... 126/273 A
4,241,718 A * 12/1980 Barnett ..... 126/21 R
4,346,692 A 8/1982 McCauley
4,354,084 A * 10/1982 Husslein et al. ..... 219/757
4,375,213 A * 3/1983 Kemp et al. ..... 126/21 A
4,386,558 A * 6/1983 Holman et al. ..... 99/386
4,454,501 A * 6/1984 Butts ..... 341/22
4,551,600 A 11/1985 Miyagawa et al.
4,601,279 A * 7/1986 Guerin ..... 126/21 A
4,616,562 A * 10/1986 Kuechler ..... 454/66
4,618,756 A * 10/1986 Schwaderer et al. ..... 219/757

(Continued)

FOREIGN PATENT DOCUMENTS

DE 102006001248 7/2007

(Continued)

OTHER PUBLICATIONS

International Search Report for PCT/US2009/038175, dated Sep. 1, 2009, 2 pages.

*Primary Examiner* — Kenneth B Rinehart
*Assistant Examiner* — Jorge Pereiro
(74) *Attorney, Agent, or Firm* — Pearne & Gordon LLP

(57) ABSTRACT

A kitchen range subframe includes air channels for passively directing air to and/or from an element enclosure within the kitchen range, and a range component shelf that is configured to mount one or more range components to the kitchen range subframe. The kitchen range subframe provides improved ventilation for the kitchen range, and mounting locations for range components such as gas lines and kitchen range controls.

19 Claims, 6 Drawing Sheets

U.S. PATENT DOCUMENTS 4,665,893 A * 5/1987 Miyagawa et al. ..... 126/299 D
4,736,729 A 4/1988 Beach
4,886,042 A * 12/1989 Bessler ..... 126/21 R
D309,659 S * 7/1990 Welsh ..... D23/387
5,019,682 A * 5/1991 Lee ..... 219/623
5,038,748 A * 8/1991 Lockwood et al. ..... 126/19 R
5,044,352 A * 9/1991 Lok ..... 126/39 R
5,215,074 A 6/1993 Wilson et al.
5,446,268 A * 8/1995 Chen ..... 219/623
5,611,327 A * 3/1997 Teixeira Filho et al. .... 126/39 R
6,098,613 A 8/2000 Wiersma
6,375,561 B1 * 4/2002 Nicolai et al. ..... 454/184
6,410,892 B1 * 6/2002 Peschl et al. ..... 219/461.1
6,444,958 B1 9/2002 Campbell
6,600,139 B2 7/2003 Perschl et al.
6,729,323 B1 5/2004 Little et al.
6,758,206 B1 7/2004 Barnes et al.
6,795,315 B1 * 9/2004 Wu et al. ..... 361/695
6,904,904 B2 6/2005 Walther et al.
6,913,012 B2 7/2005 Divett et al.
7,049,552 B2 5/2006 Arntz et al.
7,193,185 B2 3/2007 Fisher
2002/0045142 A1 * 4/2002 Repper et al. ..... 431/66
2002/0190055 A1 * 12/2002 Perschl et al. ..... 219/460.1
2004/0177841 A1 9/2004 Little et al.
2005/0089809 A9 * 4/2005 Repper et al. ..... 431/66
2006/0266349 A1 11/2006 Beck et al.
2007/0074713 A1 * 4/2007 Cadima et al. ..... 126/21 R
2007/0246453 A1 * 10/2007 Nam et al. ..... 219/413

FOREIGN PATENT DOCUMENTS

JP 2004258450 A * 9/2004
WO 2005024307 3/2005

* cited by examiner

VENTILATING KITCHEN RANGE SUBFRAME

FIELD OF THE INVENTION

The present invention relates to kitchen ranges and, in particular, to a kitchen range subframe that provides ventilation for the kitchen range element enclosure and support for one or more range components.

BACKGROUND

Kitchen ranges are typically ventilated to improve their performance. Ranges with electrical burners are typically ventilated using airflow systems to cool the range controls and the electric heating elements, and minimize the formation of hot spots on the cooktop surface. For example, U.S. Pat. No. 4,551,600 describes a mechanism for cooling the interior of an induction heating kitchen range by using a fan to drive air through various chambers underneath the cooktop and then out through ventilation holes in the cooktop. U.S. Pat. No. 6,444,958 describes another arrangement for ventilating a kitchen range in which air is drawn into the burner box by a fan and past electronic controls in another compartment in order to cool these controls and sensors mounted in the cooktop.

Kitchen ranges with gas burners may also be ventilated. For example, U.S. Pat. No. 6,729,323 provides an air inlet system for a gas kitchen range in which a louver with an airfoil portion and an attachment portion provides air and vents excess heat and exhaust from the burner box. As noted in the '323 patent, the use of electronic controls has increased the need for proper ventilation, as electronic controls generally do not require holes in the kitchen range for airflow that were associated with the earlier mechanical controls. Ventilation holes in the cooktop can be used to help improve ventilation, but these ventilation holes may be unsightly and provide the opportunity for spillage to enter the burner box.

SUMMARY OF THE INVENTION

The present invention provides a device for improving the ventilation of a cooktop, while also providing improved mounting for various oven range components. In one aspect, the invention provides a kitchen range subframe that includes one or more air channels for passively directing air to and/or from an element enclosure within the kitchen range and a range component shelf for mounting one or more range components to the kitchen range subframe. The range components may include range control devices, which may further include an electronic control panel, such as a liquid crystal display. The range control devices may also include heating element controls.

In one embodiment, the air is directed to at least one side of the element enclosure, while in another embodiment the air is directed to both sides of the element enclosure. In further embodiments, the air channels have a U-shaped cross-section. In embodiments with U-shaped air channels, air may be directed to the element enclosure through one or more airflow cutouts within an inside channel wall of the air channels.

In another aspect, the present invention provides a ventilated kitchen range that includes an element enclosure; one or more heating elements within the element enclosure; a kitchen range subframe positioned in front of the element enclosure, wherein the kitchen range subframe comprises a range component shelf and at least one air channel positioned along a side of the element enclosure for passively directing air to and/or from the element enclosure; and a cooktop configured to cover the element enclosure. Embodiments of the ventilated kitchen range may include heating elements that are gas burners. If gas burners are present, one or more gas lines may be mounted to the range component shelf in further embodiments. In additional embodiments, the kitchen range may include an oven positioned below the element enclosure.

In further embodiments of the ventilated kitchen range, there is an air channel positioned along each side of the element enclosure. The range component shelf of the ventilated kitchen range may also include one or more mounting devices configured to hold range controls. These range controls may include an electronic control panel. In additional embodiments, the electronic control panel includes a liquid crystal display, and insulation is provided between the range component shelf and the electronic control panel.

In yet further embodiments of the ventilated kitchen range, the kitchen range subframe is covered by a service panel. In these embodiments, air may enter the air channels by passing through air inlets in the service panel. Embodiments of the ventilated kitchen range may also include air channels that have a U-shaped cross-section. In embodiments with air channels having a U-shaped cross-section, the air may be directed to flow through airflow holes in the element enclosure which are aligned with one or more airflow cutouts within an inside wall of the air channels.

Figure 1:
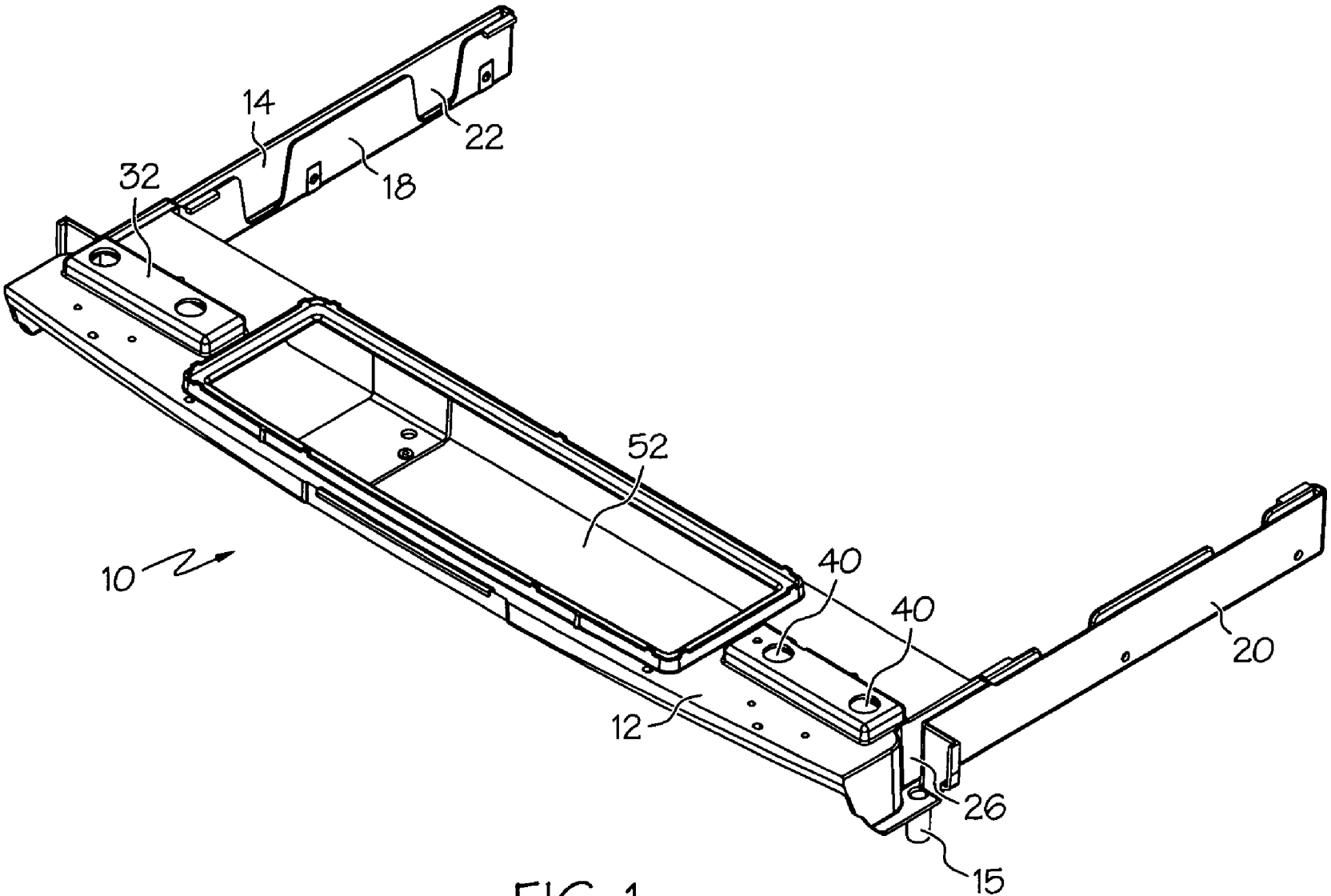
FIG. 1 is an upper right perspective view of an embodiment of a kitchen range subframe.

The following detailed description is to be read with reference to the figures, in which like elements in different figures have like reference numerals. The figures, which are not necessarily to scale, depict selected embodiments and are not intended to limit the scope of the invention. Skilled artisans will recognize the embodiments provided herein have many useful alternatives that fall within the scope of the invention.

DETAILED DESCRIPTION OF EMBODIMENTS OF THE INVENTION

The present invention provides a kitchen range subframe that fits to a kitchen range. A kitchen range subframe, as defined herein, is a component that provides a separate structure within a kitchen range to carry other range components. The subframe includes air channels for passively directing air to an element enclosure within the kitchen range and a range component shelf for mounting one or more range components to the kitchen range subframe.

An embodiment of the kitchen range subframe is shown in FIG. 1. As shown in the figure, the kitchen range subframe 10 includes a range component shelf 12. The range component shelf 12 provides a surface that is configured to hold one or more range components, such as range control devices. The kitchen range subframe 10 also includes one or more air channels 14 for directing air to the element enclosure within the kitchen range. These air channels 14 can have various configurations, but should be able to direct air flowing from outside of the kitchen range to the element enclosure, and vice versa. In addition to providing ventilation, the air channels 14 may help decrease the strength of drafts of air that may occur in the element enclosure, as a result of the configuration of the air channels 14 and their orientation relative to the airflow openings 24 in the element enclosure 16. Decreasing drafts increases gas burner reliability and efficiency.

The air channels 14 may be, for example, conduit, hose lines, or channels with a U-shaped cross-section. If an open channel such as a U-shaped channel is used, the channels should be covered (e.g., by a cooktop) to block loss of airflow along the open side of the channel. The range component shelf 12 and air channels 14 may be constructed from suitable metals or polymers known to those skilled in the art, such as injection molded polyester, and is preferably formed as a single piece. The kitchen range subframe may be attached to the oven range using a variety of methods known to those skilled in the art, such as by screw attachment to one or more screw bosses 15.

Figure 2:
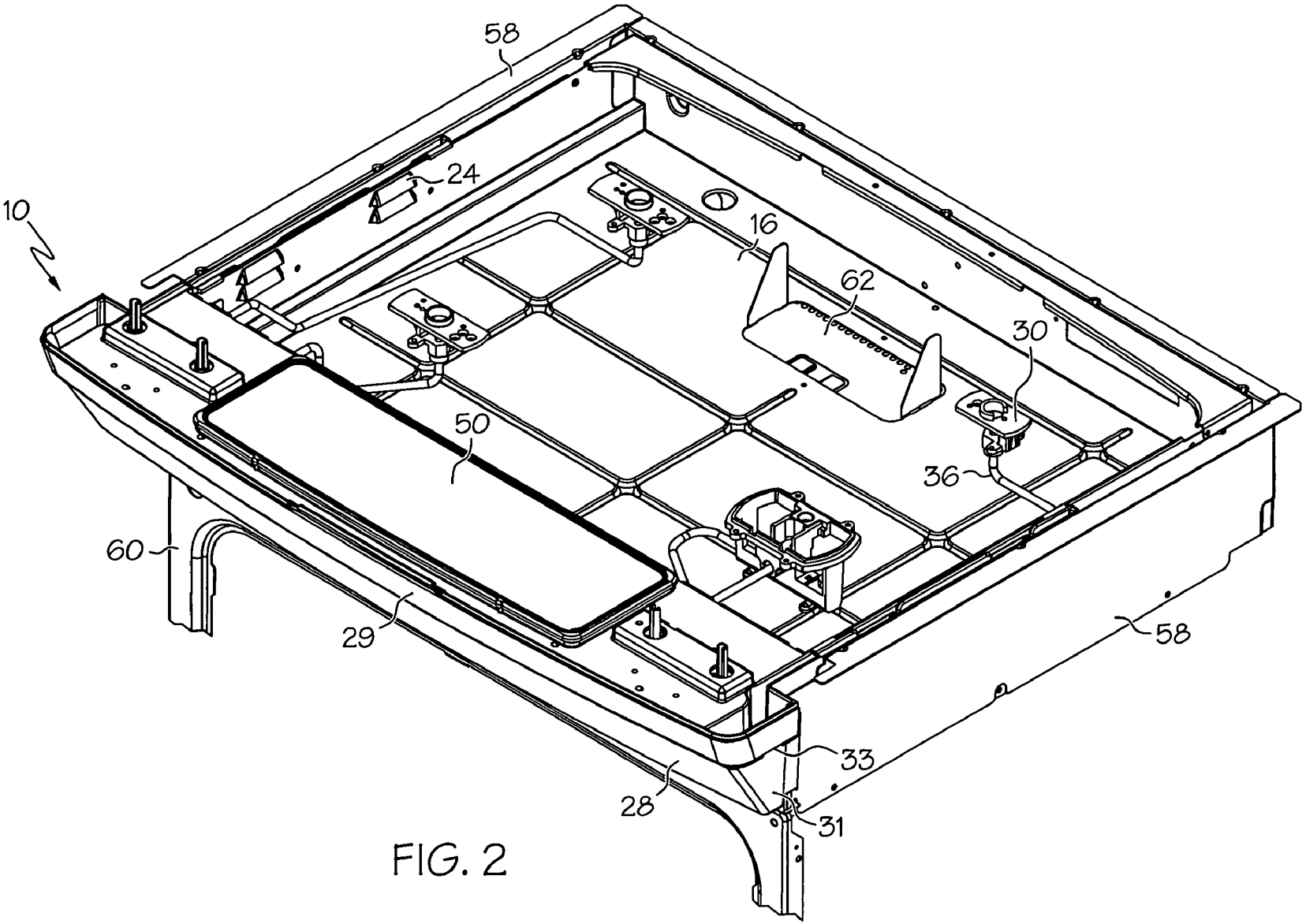
FIG. 2 is an upper right perspective view of a kitchen range subframe fitted to the front of a kitchen range, with air channels extending along the sides of the element enclosure, and covered by a service panel.

In the embodiment shown in the figures, the air channels 14 have a U-shaped cross section. As shown in FIG. 2, the air channels 14 extend from the range component shelf 12 along a portion of the sides of the element enclosure 16, and are perpendicular to the range component shelf. Preferably, the air channels 14 extend to at least the middle of the side of the element enclosure. In addition to providing airflow to the element enclosure 16, the air channels 14 can help support the kitchen range subframe 10 in place, decreasing undesirable vibration in the range component shelf 12 and the range control devices supported by the shelf. While it is preferable to have an air channel 14 along each side of the element enclosure, ventilation can also be provided using a single air channel along either side of the element enclosure.

The air channels 14, which may be U-shaped, each have an inner channel wall 18 and an outer channel wall 20, with the inner channel wall 18 being adjacent to the element enclosure 16. The inner channel wall 18 may include one or more airflow cutouts 22. The airflow cutouts 22 are preferably positioned so that they are aligned with airflow holes 24 present on the sides of the element enclosure 16, to allow air to flow between the air channel 14 and the element enclosure 16, through the airflow cutouts 22 and the airflow holes 24. The airflow holes 24 may simply be open spaces positioned on the side walls of the element enclosure 16, or they may be openings provided with louvers, as shown in FIG. 2.

Figure 4:
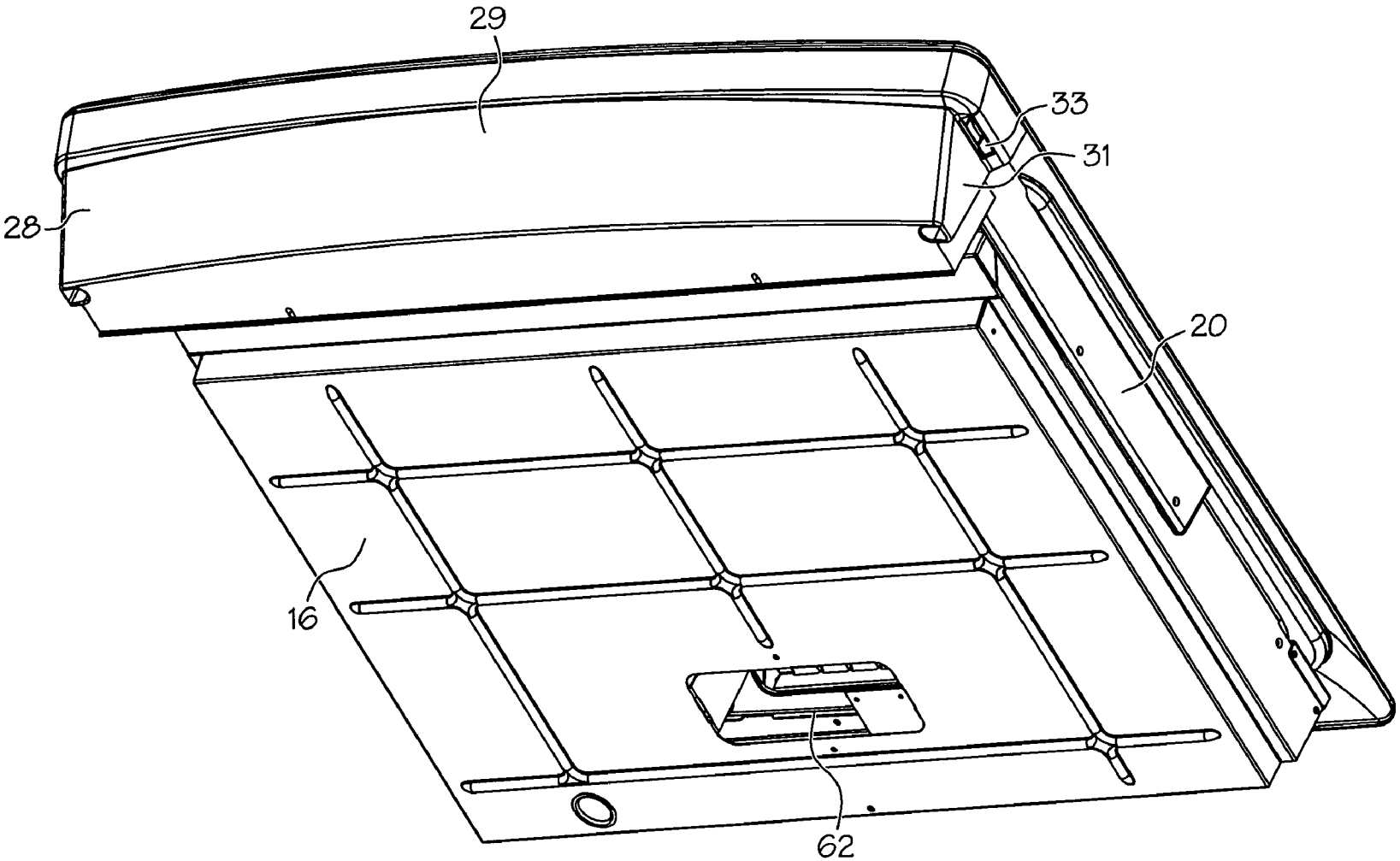
FIG. 4 is lower right perspective view of a kitchen range subframe, covered by a service panel and mounted to an element enclosure, illustrating a semi-concealed air inlet.

Air enters the air channels 14 at the channel entrance 26. In the embodiment shown in the figures, the channel entrance 26 is a point at the proximal end of the air channel 14 near the range component shelf 12 where the air channel 14 widens. As can be seen in FIG. 2, the channel entrance 26 may be covered by the service panel 28 to conceal the channel entrance 26. A front portion 29 of the service panel 28 covers a portion of the front of the kitchen range, and encloses the front of the kitchen range subframe 10, concealing oven components such as gas lines to create a more pleasing aesthetic appearance. The service panel 28 bends slightly at each end to wrap around the corners of the kitchen range subframe 10 to form side portions 31. Air may be provided to the channel entrance 26 from an air inlet 33 in the service panel 28. The air inlet 33 may be provided in a side portion 31 of the service panel 28 where it is relatively unobtrusive. The air inlet 33 may be made even more unobtrusive by placing the air inlet 33 on the downward side of a downward facing ridge on the service panel 28 so that the air inlet 33 is not visible from normal viewing angles, such that it is semi-concealed. An embodiment showing a semi-concealed air inlet 33 positioned on the side portion 31 is shown in FIG. 4.

Air may flow in both directions along the air channels 14. When the heating elements 30 of the kitchen range are gas burners, air will typically be flowing inwards from the outside to supply the gas burners with oxygen for combustion. Airflow provided by the kitchen range subframe 10 has several advantages. First, the air channels 14 allow the flow of cool, dense, outside air to reach the heating elements 30. Gas burner heating elements 30 can burn fuel more efficiently when provided with cool, dense air with an oxygen content that is higher than air that has already been warmed by the kitchen range or oven. Furthermore, by directing the air through one or more air channels 14, sudden gusts or pressure changes that may result from, for example, opening an oven door, are avoided. By avoiding gusts and providing cool, dense air, the kitchen range subframe 10 allows the gas burners to run at lower levels of gas consumption. For example, gas burners in a kitchen range ventilated by the kitchen range subframe 10 of the present invention may be run at about 500 BTU (British thermal units) per hour.

Airflow out of the element enclosure 16 may also be improved by the kitchen range subframe 10. Allowing air to flow out of the element enclosure 16 along air channels 14 positioned along the side of the element enclosure 16 directs airflow away from range control devices such as those held by the range component shelf 12. As air leaving the element enclosure is relatively warm, it is preferable to avoid having this air flow by the range control devices, which may include electronic or other components that are heat sensitive. In the absence of air channels 14 to direct airflow, the hot air in typical kitchen ranges has a tendency to leak from the element enclosure 16 to the range control devices through small openings in the element enclosure 16. While passive airflow (i.e., airflow that is not mechanically forced, such as natural convection) is preferred, one or more fans may be installed within the element enclosure or along the air channels in alternate embodiments of the invention to increase airflow. Ventilation, as defined herein, includes both airflow into and/or out of the element enclosure 16.

The kitchen range subframe 10 includes a range component shelf 12 that is configured for mounting one or more range components. Mounting the range components to the range component shelf 12 improves the structural soundness of the kitchen range by fastening the range components in place. This may also allow interrelated components to be located with precision. Preferably, the range components are fixed in a manner that decreases their overall tolerance stacking. Range components include range control devices such as heating element controls 34, an electronic control panel 50, and other range components such as gas lines. Range control devices are preferably mounted in elevated regions 32 so that spillage flows away from the range control devices and onto the lower regions of the range component shelf 12.

Figure 3:
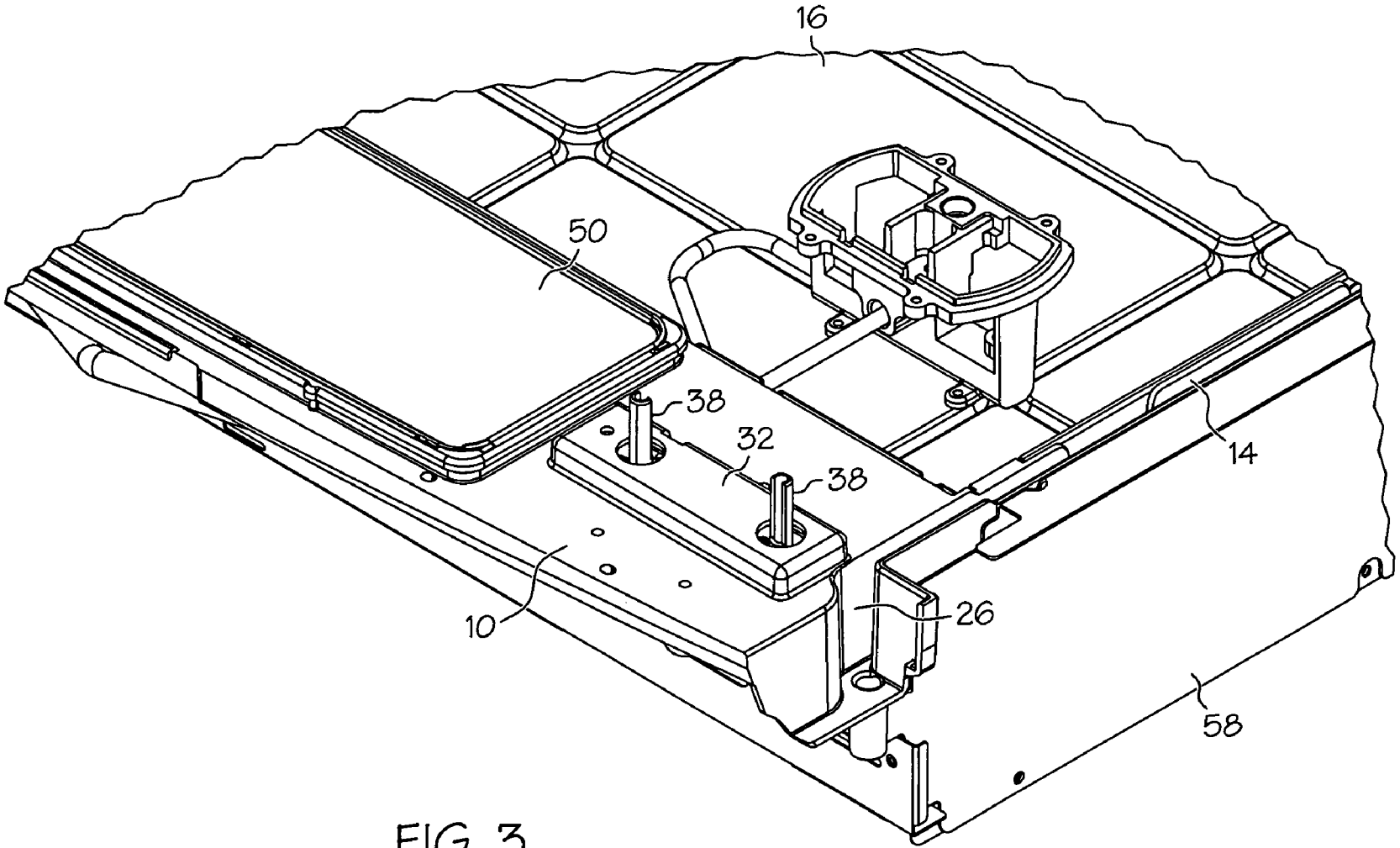
FIG. 3 is a partial upper right perspective view of a kitchen range subframe, illustrating placement of kitchen range controls in the range component shelf.
Figure 5:
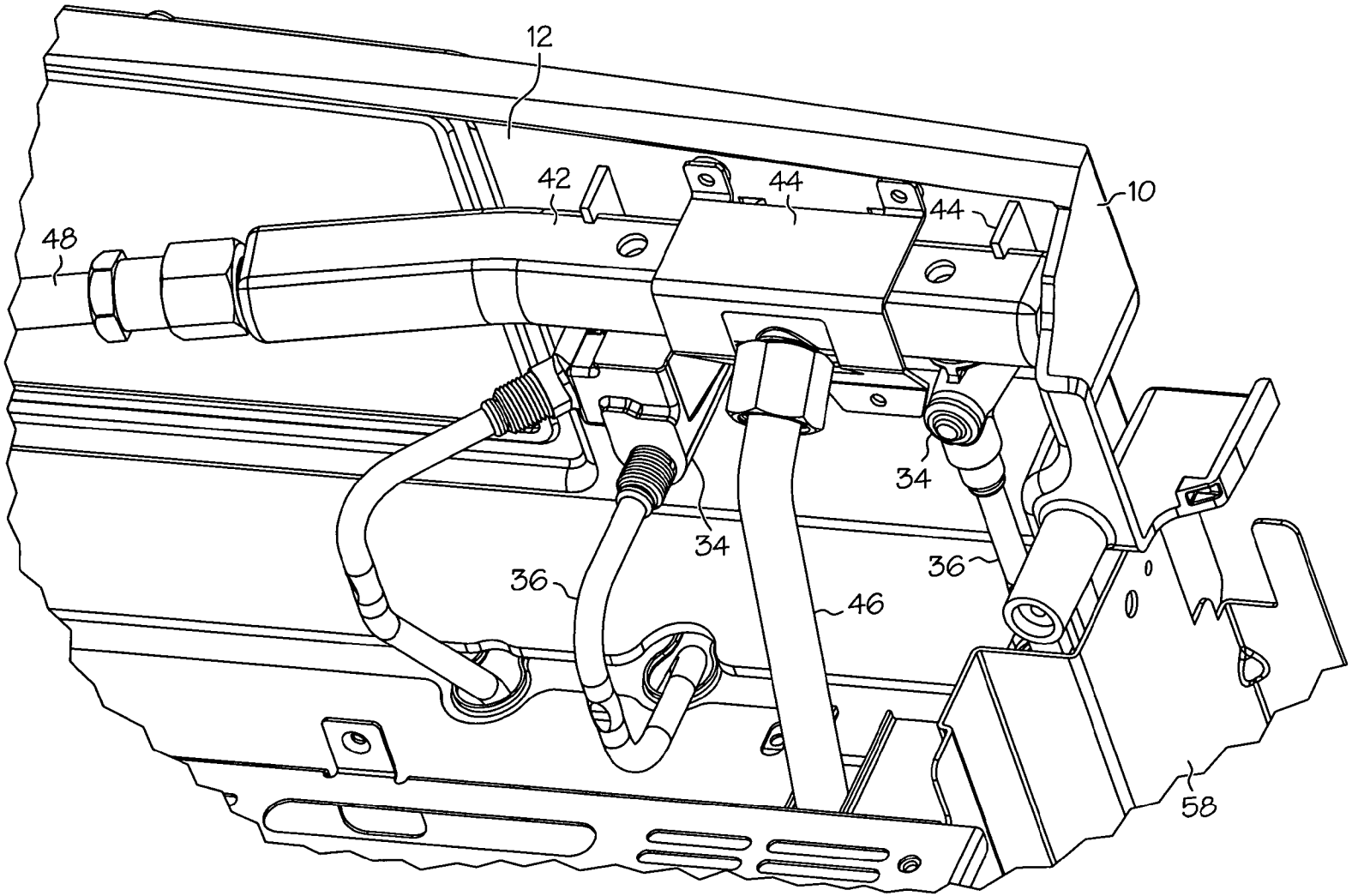
FIG. 5 is a partial lower right perspective view of a kitchen range subframe, illustrating attachment of the gas lines to the range component shelf.

Examples of how the heating element controls 34 and gas burner lines 36 can be mounted are shown in FIGS. 3 and 5, respectively. The heating element controls 34 are attached to the range component shelf 12 so that the control knobs 38 protrude through knob holes 40 provided in the range component shelf 12. Control dials (not shown) are typically placed on the control knobs 38 before use to more readily control the amount of heat provided by the heating elements 30. In the embodiment shown in FIG. 5, the heating element controls 34 are secured to the range component shelf 12 by attaching them to a gas manifold 42, which is a hollow shape configured for attachment to the range component shelf 12. The gas manifold 42 may be secured to the range component shelf 12 by attachment clips 44 and/or other attachment means, such as adhesives or screw attachment. The attachment clips 44 may be shaped to retain the gas manifold or other oven components in place, or they may simply help position the components which are then secured by other means, such as adhesive or screw attachment.

Figure 6:
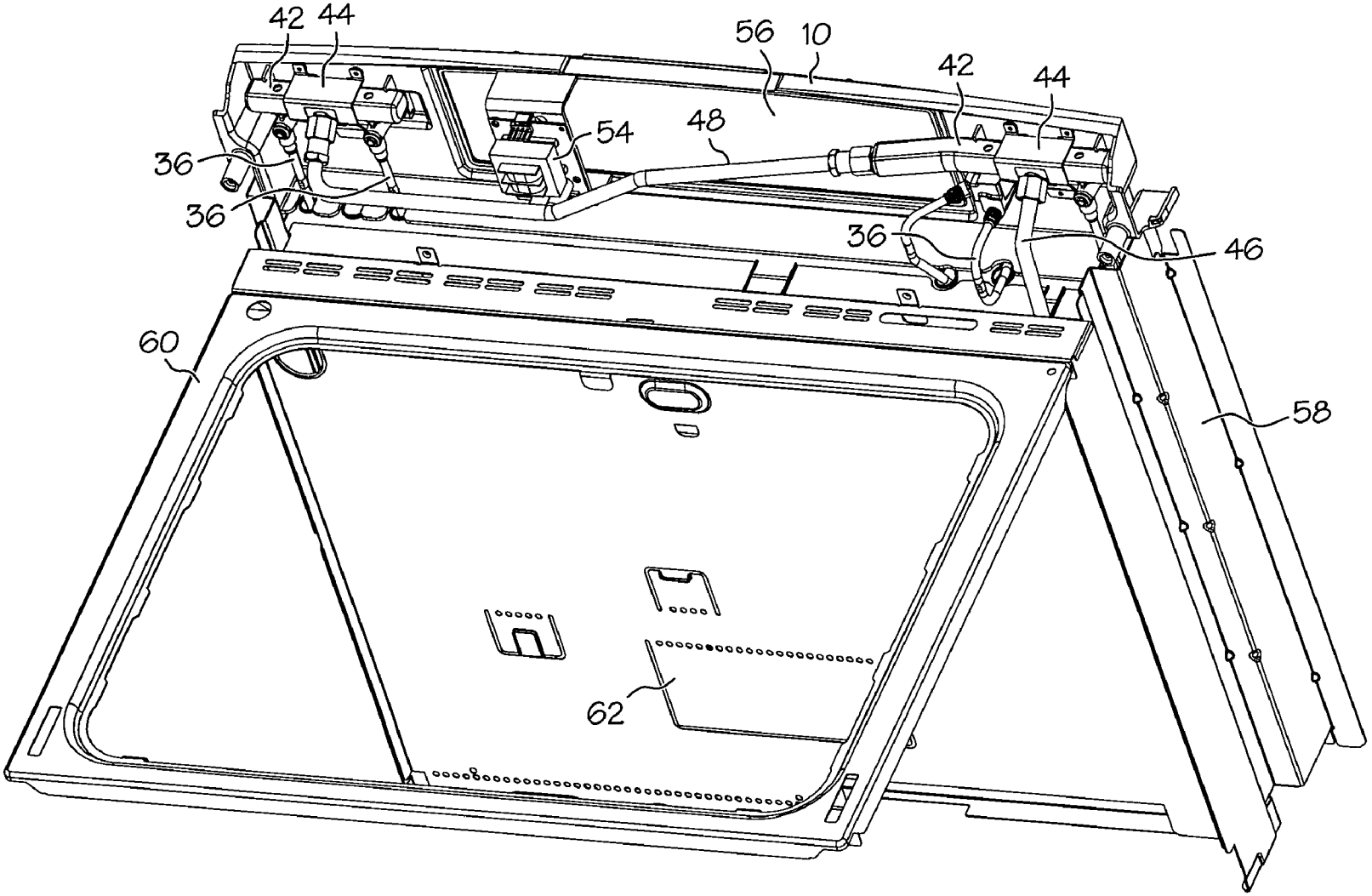
FIG. 6 is a partial lower right perspective view of a kitchen range subframe, illustrating the attachment of two gas manifolds and a power supply underneath the range component shelf.

Gas flows from the gas input line 46 to the gas manifold 42, and then out through the gas burner lines 36 and the transfer line 48, which directs gas from a gas manifold 42 on one side of the kitchen range subframe 10 to a gas manifold 42 on the other side of the kitchen range subframe 10. Note that some types of gas burner heating elements 30 may require multiple gas lines 36 as shown in the Figures. An arrangement of the two gas manifolds 42 on left and right sides of the kitchen range subframe 10 and their connection through a transfer line 48 is illustrated by FIG. 6.

The range component shelf 12 may also be configured to hold an electronic control panel 50. For example, the range component shelf 12 may be provided with a display recess 52 in which the electronic control panel 50 can be held. The electronic control panel 50 includes microprocessors and may include various other items, such as analog/digital converters to allow data to be entered into the microprocessor from external sensors, a clock, and various entry keys or touch sensitive controls with functions such as bake, broil, and self-clean. The electronic control panel 50 is typically used primarily as an oven control for kitchen ranges that include an oven. The electronic control panel 50 is typically connected to a power supply 54 (e.g., a transformer) that may be attached to the range component shelf 12, as shown in FIG. 6.

The electronic control panel 50 may also include displays, such as liquid crystal displays (LCD's) to provide information. When heat sensitive components such as LCD's are included in the electronic control panel 50, it is preferable to also include a layer of insulation 56 under the LCD to help isolate it from heat generated within the kitchen range. The insulation 56 may be a single layer of material, or it may be multiple layers, such as a metal panel and a layer of fibrous insulating material. The air channels 14 also help enable the use of LCD's by channeling hot air away from the electronic control panel 50.

A kitchen range, as defined herein, includes a stove, which is a cooking appliance that includes one or more heating elements to heat cooking items such as pots and pans that are placed on its surface. The kitchen range may or may not also include an oven 60, which is an enclosed space generally provided with a separate set of heating elements that is used for cooking techniques such as baking and broiling. The front door portion of the oven 60 is shown in FIG. 6, which illustrates the relative positions of the oven 60 and the element enclosure 16. The term kitchen range refers to a device that is used for cooking; it need not necessarily be placed in a kitchen. The kitchen range may be provided as a stand alone cabinet, or it may be set into kitchen cabinetry using a cutout. The kitchen range has a front, which includes the range control devices and the oven door, if an oven 60 is included. The kitchen range also includes a rear, which is the side of the kitchen range opposite from the front, and two sides, which run from the front to the rear sides of the kitchen range.

FIG. 2 shows a kitchen range including a kitchen range subframe 10 that is configured to be placed in a 3-sided rectangular cutout in, for example, a kitchen countertop. The range component shelf 12 of the embodiment of the kitchen range subframe 10 shown is placed near the front of the kitchen range, adjacent to the element enclosure 16, where the range component shelf 12 provide easy manual access to the kitchen range controls. The range component shelf 12 may be horizontal and aligned with the cooktop, as shown in the figures, or it may be angled downward relative to the cooktop, depending on which configuration is perceived to provide easier access to the kitchen range controls.

The kitchen range includes an element enclosure 16 that includes one or more heating elements 30. The heat elements may be gas burners or electrical heating elements 30. If the heating elements 30 are gas burners, the element enclosure 16 will also include one or more gas burner lines 36 that provide gas to the gas burners. The element enclosure 16 may be set within insert shelves 58 that are placed along the edges of the cutout in a kitchen countertop. A cooktop (e.g., a glass cooktop) is typically placed over the element enclosure 16 to provide a cooking surface over the heating elements 30. The air channels 14 of the kitchen range subframe 10 extend from the range component shelf 12 and rest or are secured between the element enclosure 16 and the insert shelves 58. The air channels 14 can position and support the kitchen range subframe 10 while directing air from the outside to the element enclosure 16, and/or directing air from the element enclosure 16 to the outside.

As noted herein, the kitchen range may include an oven 60. The oven 60, if present, is typically provided below the element enclosure 16. Operation of the oven is typically controlled by the electronic control panel 50. Oven airflow openings 62 may be present in the element enclosure 16. The one or more oven airflow openings 62 are typically mated to an exhaust pipe (not shown) that directs hot oven air through the element enclosure 16 without mixing oven air with air in the element enclosure.

While various embodiments in accordance with the present invention have been shown and described, it is understood the invention is not limited thereto, and is susceptible to numerous changes and modifications as known to those skilled in the art. Therefore, this invention is not limited to the details shown and described herein, and includes all such changes and modifications as encompassed by the scope of the appended claims.

What is claimed is:

1. A kitchen range subframe, comprising one or more air channels for passively directing air to and/or from an element enclosure within the kitchen range and a range component shelf for mounting one or more range components to the kitchen range subframe, wherein the one or more air channels extend from the range component shelf along a portion of at least one side of the element enclosure such that the one or more air channels is substantially perpendicular to the range component shelf, further wherein air is directed to the element enclosure through one or more airflow cutouts within an inside channel wall of the air channels which are aligned with airflow holes in the element enclosure.

2. The kitchen range subframe of claim 1, wherein the range components comprise range control devices.

3. The kitchen range subframe of claim 2, wherein the range control devices comprise an electronic control panel.

4. The kitchen range subframe of claim 3, wherein the electronic control panel comprises a liquid crystal display.

5. The kitchen range subframe of claim 2, wherein the range control devices comprise heating element controls.

6. The kitchen range subframe of claim 1, wherein the air is directed to at least one side of the element enclosure.

7. The kitchen range subframe of claim 6, wherein the air is directed to both sides of the element enclosure.

8. The kitchen range subframe of claim 1, wherein the air channels have a U-shaped cross-section.

9. A ventilated kitchen range, comprising:

an element enclosure;

one or more heating elements within the element enclosure;

a kitchen range subframe positioned in front of the element enclosure, wherein the kitchen range subframe comprises a range component shelf and at least one air channel positioned along a side of the element enclosure, wherein the air channels are configured to allow flow of outside air into sides of the element enclosure to reach the one or more heating elements; and a cooktop configured to cover the element enclosure, further wherein a flow of air directed from the enclosure is directed away from range control devices.

10. The ventilated kitchen range of claim 9, wherein the heating elements are gas burners.

11. The ventilated kitchen range of claim 10, wherein one or more gas lines are mounted to the range component shelf.

12. The ventilated kitchen range of claim 9, wherein there is an air channel positioned along each side of the element enclosure.

13. The ventilated kitchen range of claim 9, wherein the range component shelf includes one or more mounting devices configured to hold range controls.

14. The ventilated kitchen range of claim 13, wherein the range controls comprise an electronic control panel.

15. The ventilated kitchen range of claim 14, wherein the electronic control panel comprises a liquid crystal display, and insulation is provided between the range component shelf and the electronic control panel.

16. The ventilated kitchen range of claim 9, wherein the kitchen range subframe is covered by a service panel.

17. The ventilated kitchen range of claim 16, wherein the air enters the air channels by passing through air inlets in the service panel.

18. The ventilated kitchen range of claim 9, wherein the air channels have a U-shaped cross-section.

19. A ventilated kitchen range, comprising:

an element enclosure;

one or more heating elements within the element enclosure;

a kitchen range subframe positioned in front of the element enclosure, wherein the kitchen range subframe comprises a range component shelf and at least one air channel positioned along a side of the element enclosure for passively directing air to and from the element enclosure; and a cooktop configured to cover the element enclosure;

wherein air is directed to flow through airflow holes in the element enclosure which are aligned with one or more airflow cutouts within an inside wall of the at least one channel.

* * * * *